US011458347B2

(12) United States Patent
Sundblad et al.

(10) Patent No.: US 11,458,347 B2
(45) Date of Patent: Oct. 4, 2022

(54) KETTLEBELL HANDLE WITH WEIGHT ATTACHMENT MEANS

(71) Applicant: Maple Movements, Inc., Walpole, MA (US)

(72) Inventors: Andrew Sundblad, Oakland, CA (US); Shaun Kjellman, Kirkland, WA (US)

(73) Assignee: MAPLE MOVEMENTS, INC., Walpole, MA (US)

( * ) Notice: Subject to any disclaimer, the term of this patent is extended or adjusted under 35 U.S.C. 154(b) by 71 days.

(21) Appl. No.: 17/076,691

(22) Filed: Oct. 21, 2020

(65) Prior Publication Data

US 2021/0154520 A1 May 27, 2021

Related U.S. Application Data

(60) Provisional application No. 62/939,444, filed on Nov. 22, 2019.

(51) Int. Cl.
*A63B 21/075* (2006.01)
*A63B 21/00* (2006.01)

(52) U.S. Cl.
CPC ..... *A63B 21/075* (2013.01); *A63B 21/4035* (2015.10)

(58) Field of Classification Search
CPC ..... A63B 21/4035; A63B 21/0726; A63B 21/0728; A63B 2209/00; A63B 51/072; A63B 51/0724; A63B 51/0728; A63B 51/075; A63B 51/4035; A63B 2225/09; A63B 21/00–0004; A63B 21/00061; A63B 21/00065; A63B 21/06–0607; A63B 21/072–075; A63B 21/4019; A63B 21/4023; Y10T 403/589
See application file for complete search history.

(56) References Cited

U.S. PATENT DOCUMENTS 5,842,810 A * 12/1998 Morad ..... B25G 3/18 15/147.1
7,563,208 B1 * 7/2009 Chen ..... A63B 21/075 482/93
7,731,640 B1 * 6/2010 Chen ..... A63B 21/075 482/93
9,127,699 B2 * 9/2015 Lambertson, Jr. .... F16B 7/0406
(Continued)

OTHER PUBLICATIONS

International Search Report and Written Opinion issued for PCT/US2020/058601, dated Feb. 1, 2020, 9 pages.

*Primary Examiner* — Jennifer Robertson
*Assistant Examiner* — Catrina A Letterman
(74) *Attorney, Agent, or Firm* — Brooks Kushman P.C.

(57) ABSTRACT

An exercise device includes a rigid handle having a lower end and an upper end. The upper end is adapted for grasping by a person's hand, and the lower end is fixed with a shaft receiver. A bottom end of the shaft receiver is adapted for receiving a top end of a rigid shaft that is adapted to receive one or more weights. A weight stop projects away from a lower end of the rigid shaft to prevent the weights from sliding off of the rigid shaft. In use, with one or more of the weights fixed on the rigid shaft, and with the top end of the rigid shaft fixed with the shaft receiver, the person may grasp the handle to perform exercises. A latch of the shaft receiver selectively locks the rigid shaft with the shaft receiver. The shaft and shaft receiver may include cooperative screw threads.

19 Claims, 4 Drawing Sheets

(56) References Cited

U.S. PATENT DOCUMENTS

| | | | | |
|---|---|---|---|---|
| 2007/0135274 | A1* | 6/2007 | Blateri | A63B 21/075 482/109 |
| 2009/0062085 | A1 | 3/2009 | Polevoy et al. | |
| 2010/0190619 | A1* | 7/2010 | Chen | A63B 21/072 482/108 |
| 2014/0057764 | A1* | 2/2014 | Klukas | A63B 21/0728 482/109 |
| 2015/0105224 | A1* | 4/2015 | Odneal | A63B 21/0726 164/47 |
| 2018/0117387 | A1* | 5/2018 | Wang | A63B 21/072 |
| 2019/0217146 | A1* | 7/2019 | Sisler | A63B 21/4035 |

* cited by examiner

KETTLEBELL HANDLE WITH WEIGHT ATTACHMENT MEANS

CROSS-REFERENCE TO RELATED APPLICATIONS

This application claims the benefit of U.S. Provisional Patent Application 62/939,444, filed on Nov. 22, 2019, and is incorporated herein by reference.

STATEMENT REGARDING FEDERALLY SPONSORED RESEARCH OR DEVELOPMENT

Not Applicable.

TECHNICAL FIELD

This invention relates to exercising, and more particularly to a kettlebell-type exercising device.

BACKGROUND

Kettlebell type exercises are gaining in popularity, and as such people are finding usability issues with the traditional one-piece kettlebell that is of a particular weight. For many exercisers the kettlebell weight is either too heavy or too light, and thus it would be advantageous to adjust such a kettlebell device to a selected weight. However, adding weights to a dumbbell or kettlebell type device is cumbersome at best or impossible at worst.

Therefore, there is a need for an exercise device that allows a person to adjust the amount of weight thereon. Such an invention would allow quick exchange, removal, or addition of weights to the device. Such a needed device would be intuitive to use, relatively easy to manufacture, and easy to store and transport. The present invention accomplishes these objectives.

SUMMARY

The present device is an exercise device for grasping by a hand of a person, and for holding one or more weights. A rigid handle has a lower end and an upper end. The upper end is adapted for grasping by the person's hand.

A weight attachment mechanism has a shaft receiver and a rigid shaft. The shaft receiver is fixed at a top end thereof with the lower end of the handle. A bottom end of the shaft receiver is adapted for receiving a top end of the rigid shaft. The rigid shaft is adapted to receive each weight thereon at the top end of the rigid shaft. A weight stop projects away from a lower end of the rigid shaft and is adapted to prevent the weights from sliding off of the rigid shaft at the lower end thereof.

In use, with one or more of the weights fixed on the rigid shaft, and with the top end of the rigid shaft fixed with the shaft receiver, the person may grasp the handle to perform exercises.

Preferably the top end of the rigid shaft includes a raised catch, and the shaft receiver includes a latch projecting inwardly to engage the catch when the rigid shaft is fully received in the shaft receiver. As such, when the one or more weights are positioned on the rigid shaft and the top end of the rigid shaft is inserted into the shaft receiver, the latch engages the catch to prevent the rigid shaft from separating from the shaft receiver.

In some embodiments the top end of the rigid shaft includes an outer thread, and the shaft receiver includes a cooperating internal thread, such that the rigid shaft may be screwed into the shaft receiver until the latch engages the catch. In such embodiments, preferably the latch is urged inwardly with a spring. A leading edge of the catch and a leading edge of the latch are cooperatively sloped to allow the catch to move the latch outwardly from the shaft receiver to allow the catch to pass under the latch, after which the latch is urged back inwardly to engage the catch. To unscrew the rigid shaft from the shaft receiver in such an embodiment, the person manually pulls the latch outward while unscrewing the handle relative to the rigid shaft.

The present invention is an exercise device that allows a person to adjust the amount of weight thereon. The present device allows quick exchange, removal, or addition of weights to the device, and is intuitive to use, relatively easy to manufacture, and easy to store and transport. Other features and advantages of the present invention will become apparent from the following more detailed description, taken in conjunction with the accompanying drawings, which illustrate, by way of example, the principles of the invention.

DETAILED DESCRIPTION

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
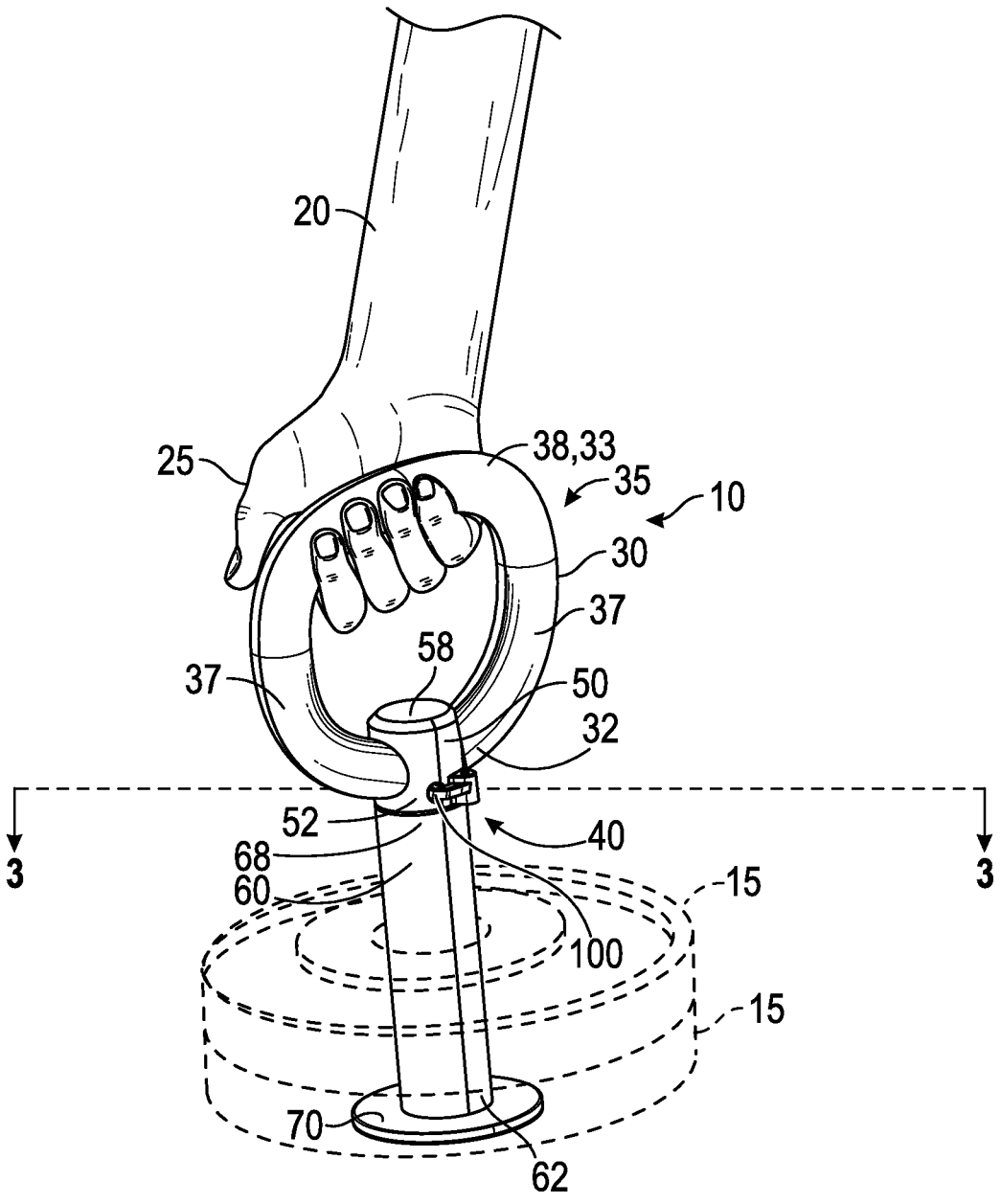
FIG. 1 is a perspective view of the invention, illustrated with a rigid shaft engaged with a shaft receiver to contain a plurality of weights.
Figure 2:
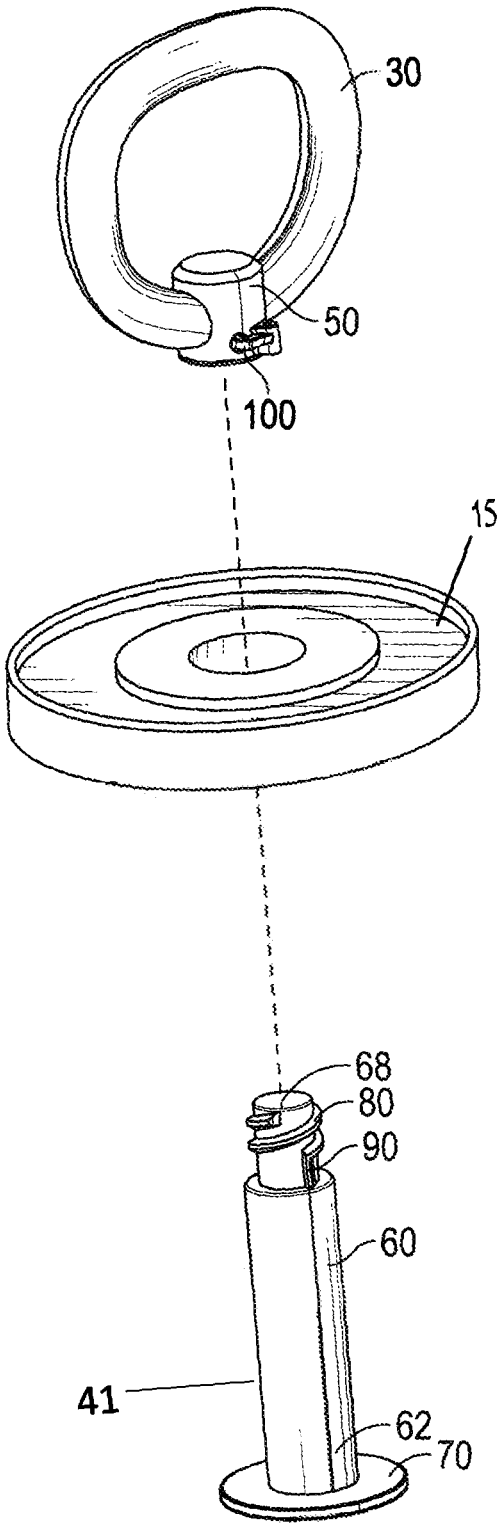
FIG. 2 is an exploded perspective view of the invention.

FIGS. 1 and 2 illustrate an exercise device 10 for grasping by a hand 25 of a person 20, and for holding one or more weights 15. A rigid handle 30 has a lower end 32 and an upper end 38. The upper end 38 is adapted for grasping by the person's hand 25. Preferably the rigid handle 30 is made with a metallic material, and is formed into a loop 35 with the upper end 38 of the handle 30 including a straight portion 33, and with the lower end 32 of the handle 30 having at least one curved portion 37.

A weight attachment mechanism 40 has a shaft receiver 50 and a rigid shaft 60. The shaft receiver 50 is fixed at a top end 58 thereof with the lower end 32 of the handle 30. The handle 30 may be welded to the shaft receiver 50. That is, the shaft receiver 50 may be a cylindrical base portion of the handle 30. A bottom end 52 of the shaft receiver 50 is adapted for receiving a top end 68 of the rigid shaft 60. The rigid shaft 60 is adapted to receive each weight 15 thereon at the top end 68 of the rigid shaft 60. Preferably the weight attachment mechanism is made with a metallic material, and the lower end 32 of the handle 30 is either welded to the shaft receiver 50 or fixed at least partially through the shaft receiver 50.

A weight stop 70 projects away from a lower end 62 of the rigid shaft 60 and is adapted to prevent the weights 15 from sliding off of the rigid shaft 60 at the lower end 62 thereof. The weight stop 70 and the shaft 60 cooperate to form a weight holder 41 of the weight attachment mechanism 40.

In use, with one or more of the weights 15 fixed on the rigid shaft 60, and with the top end 68 of the rigid shaft 60 fixed with the shaft receiver 50, the person 20 may grasp the handle 30 to perform exercises.

Figure 3:
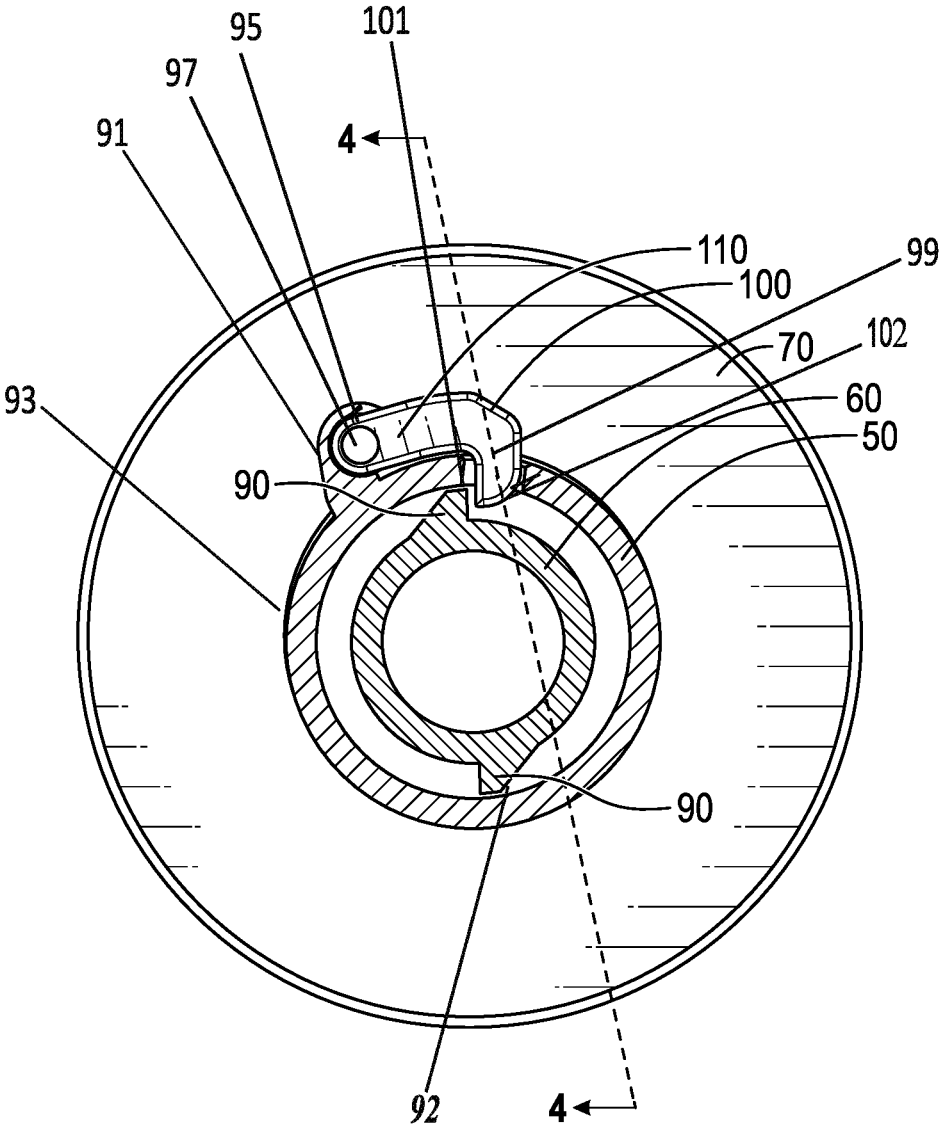
FIG. 3 is a cross-sectional view of the invention, taken along line 3-3 of FIG. 2.
Figure 4:
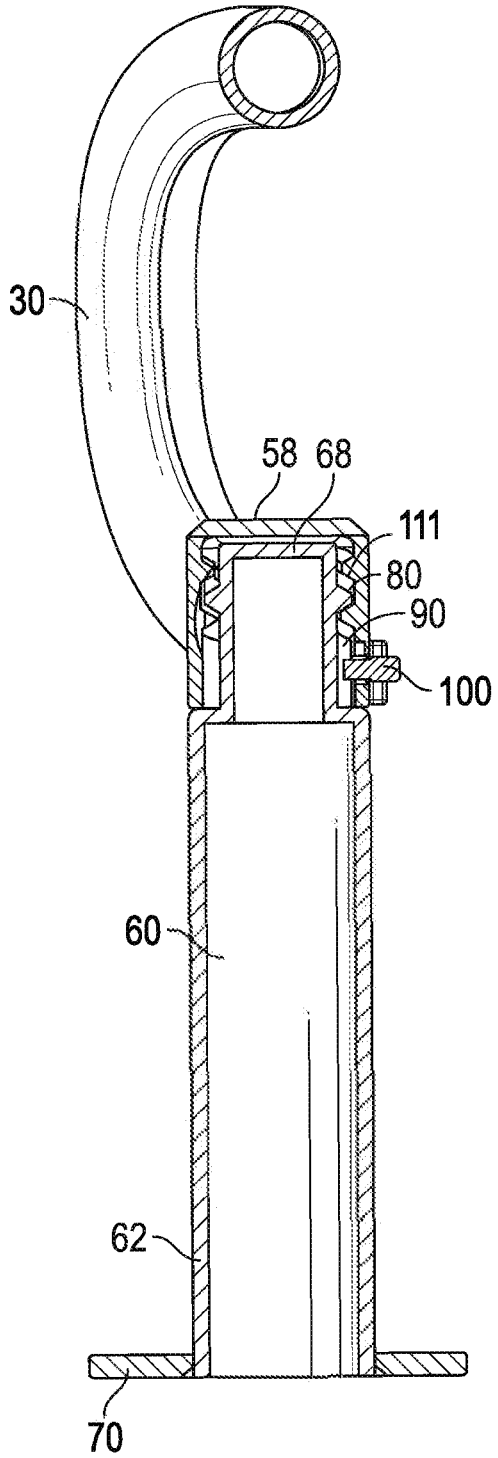
FIG. 4 is a cross-sectional view of the invention, taken along line 4-4 of FIG. 3.

Preferably the top end 68 of the rigid shaft 60 includes a raised catch 90, and the shaft receiver 50 includes a latch 100 projecting inwardly to engage the catch 90 when the rigid shaft 60 is fully received in the shaft receiver 50. As such, when the one or more weights are positioned on the rigid shaft 60 and the top end 68 of the rigid shaft 60 is inserted into the shaft receiver 50, the latch 100 engages the catch 90 to prevent the rigid shaft 60 from separating from the shaft receiver 50 (FIGS. 3-4). In the illustrated embodiment, the shaft receiver 50 may include a boss 91 on an outer circumferential surface 93 of the receiver 50. A fixed end 95 of the latch 100 is pivotally connected to the boss 91, such as by a pin 97. A tip 99 of the latch 100, which may be curved, is configured to engage the catch 90 by extending through a hole 101 defined in the shaft receiver 50. The pin 97 may be arranged parallel to an axial direction of the rigid shaft 60 as best shown in FIG. 3.

In some embodiments the top end 68 of the rigid shaft 60 includes an outer thread 80, e.g., helical threads, and the shaft receiver includes a cooperating internal thread 111, e.g., helical threads, such that the rigid shaft 60 may be screwed into the shaft receiver 50 until the latch 100 engages the catch 90. In such embodiments, preferably the latch 100 is urged inwardly with a spring 110, resilient foam (not shown), or the like. A leading edge 92 of the catch 90 and a leading edge 102 of the latch 100 are cooperatively sloped to allow the catch 90 to move the latch 100 outwardly from the shaft receiver 50 to allow the catch 90 to pass under the latch 100, after which the latch 100 is urged back inwardly to engage the catch. To unscrew the rigid shaft 60 from the shaft receiver 50 in such an embodiment, the person 20 manually pulls the latch 100 outward while unscrewing the handle 30 relative to the rigid shaft 60. The shaft 60 may include a main portion extending between the upper end 68 and the lower end 62. The main portion has a first diameter that is larger than a second diameter of upper end 68 where the threads 80 are located.

While a particular form of the invention has been illustrated and described, it will be apparent that various modifications can be made without departing from the spirit and scope of the invention. For example, the shaft receiver 50 may include a plurality of the latches 100 while the rigid shaft 60 may include one or more of the corresponding catches 90. As such the rigid shaft 60 may be inserted into the shaft receiver 50 until the plurality of latches 100 engage the one or more catches 90 (not shown). Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise device for grasping by a person's hand and for holding one or more weights, comprising:

a rigid handle having a lower end and an upper end, the upper end adapted for grasping by the person's hand;

a weight attachment mechanism having a shaft receiver at a lower end of the rigid handle and a rigid shaft that is receivable within the shaft receiver and adapted to receive one or more weights thereon, wherein the shaft receiver defines internal helical threads and a hole extending through a sidewall of the shaft receiver, wherein the rigid shaft defines external helical threads and an axially extending catch, and wherein the rigid shaft is attachable to the shaft receiver by inserting the rigid shaft into the shaft receiver and rotating the rigid shaft in a first direction so that the internal and external threads screw together;

a weight stop projecting away from a bottom end of the rigid shaft and adapted to prevent the weights from sliding off of the rigid shaft; and a latch pivotally attached to the shaft receiver so that the latch is movable within the hole to engage with the catch to inhibit rotation of the shaft in a second direction opposite the first direction and to release with the catch to allow removal of the rigid shaft from the shaft receiver.

2. The exercise device of claim 1 wherein the handle and the weight attachment mechanism are formed with a metallic material.

3. The exercise device of claim 2 wherein the handle is welded to the shaft receiver of the weight attachment mechanism.

4. The exercise device of claim 2 wherein the handle is fixed at least partially through the shaft receiver of the weight attachment mechanism.

5. The exercise device of claim 1 wherein the handle is formed into a loop.

6. The exercise device of claim 5 wherein the upper end of the handle has a straight portion, and wherein the lower end of the handle has a curved portion.

7. The exercise device of claim 1 wherein a pivot axis of the latch is parallel to an axial direction of the rigid shaft.

8. The exercise device of claim 1 wherein the latch is urged with a spring inwardly, and wherein a leading edge of the catch and a leading edge of the latch are cooperatively sloped to allow the catch to move the latch outwardly from the shaft receiver to allow the catch to pass under the latch, after which the latch is urged back inwardly by the spring to engage the catch, and whereby to unscrew the rigid shaft from the shaft receiver the person manually pulls the latch outward while unscrewing the handle relative to the rigid shaft.

9. An exercise device for grasping by a person's hand and for holding one or more weights, comprising:

a handle including a cylindrical base portion and a grasping portion, the cylindrical base portion having an outer circumferential surface and having an inner circumferential surface defining internal helical threads, wherein the base portion further defines a hole extending from the outer surface to the inner surface;

a weight holder including a shaft adapted to receive one or more weights and a weight stop attached to a lower end of the shaft and adapted to prevent the one or more weights from sliding off of the shaft, the shaft including an upper portion defining external helical threads and defining an axially extending catch, wherein the weight holder is attachable to the handle by inserting the upper portion of the shaft into the base portion and rotating the shaft in a first direction so that the internal and external threads screw together; and a latch including an end pivotally attached to the outer circumferential surface of the base portion and a curved tip receivable through the hole to engage with the catch to inhibit rotation of the shaft in a second direction opposite the first direction to secure the weight holder to the handle.

10. The exercise device of claim 9 wherein the latch is pivotal between a latching position in which the tip and the catch are connectable and an unlatched position in which the tip is radially outboard of the catch.

11. The exercise device of claim 10 wherein the latch is biased to the latching position.

12. The exercise device of claim 11 wherein the latch is biased by a spring.

13. The exercise device of claim 9 wherein a pivot axis of the latch is parallel to an axial direction of the cylindrical base portion.

14. The exercise device of claim 9 wherein a leading edge of the catch and a leading edge of the tip are cooperatively sloped to allow the tip to ratchet over the catch in the first direction.

15. The exercise device of claim 9 wherein the catch is located between the external threads and the weight stop.

16. The exercise device of claim 9 wherein the shaft includes a main portion extending between the upper portion and the lower end, the main portion having a first diameter that is larger than a second diameter of the upper portion.

17. The exercise device of claim 16 wherein the outer surface of the cylindrical base portion has a third diameter that is equal to the first diameter.

18. The exercise device of claim 9 wherein the cylindrical base portion includes a boss disposed on the outer surface, and wherein the latch includes a pin extending though the boss and the end of the latch.

19. An adjustable weight kettlebell comprising:

a handle including a base portion defining internal helical threads and a hole extending through a sidewall of the base portion;

a shaft adapted to extend through one or more weights, the shaft defining external helical threads and an axially extending catch, wherein the shaft is attachable to the handle by inserting an upper portion of the shaft into the base portion and rotating the shaft in a first direction so that the internal and external threads screw together;

a weight stop attached to a lower end of the shaft and adapted to prevent the one or more weights from sliding off of the shaft; and a latch pivotally attached to the base portion so that the latch is movable within in the hole to engage or disengage with the catch to inhibit rotation of the shaft and permit rotation of the shaft.

* * * * *